United States Patent [19]

Bauer et al.

[11] 4,248,058

[45] Feb. 3, 1981

[54] DIFFERENTIAL PISTON TYPE REVERSING VALVE CONSTRUCTION, SYSTEM UTILIZING THE SAME AND METHOD OF MAKING

[75] Inventors: Werner R. Bauer, Richmond, Va.; James T. Candor, Washington Township, Montgomery County, Ohio

[73] Assignee: Robertshaw Controls Company, Richmond, Va.

[21] Appl. No.: 27,007

[22] Filed: Apr. 4, 1979

[51] Int. Cl.[3] ..... F25B 13/00; E03B 3/00

[52] U.S. Cl. ..... 62/324 A; 137/625.43; 236/80 G

[58] Field of Search ..... 62/324 A; 137/625.43, 137/625.63, 625.64; 236/80 G, 80 E; 251/31

[56] References Cited

U.S. PATENT DOCUMENTS

| | | | |
|---|---|---|---|
| 2,329,001 | 9/1943 | Robinson | 236/80 UX |
| 3,369,790 | 2/1968 | McHale et al. | 137/625.43 |
| 3,736,958 | 6/1973 | Rostad | 137/625.6 |
| 3,894,561 | 7/1975 | Thornbery | 137/625.43 |

*Primary Examiner*—William E. Wayner

*Attorney, Agent, or Firm*—Candor, Candor & Tassone

[57] ABSTRACT

A differential piston type reversing valve construction having a housing body provided with a high pressure chamber that has a valve member slideable therein for selectively interconnecting said high pressure chamber to either port of a pair of ports interrupting a valve seat of the housing body while interconnecting a low pressure port of the valve seat to the other port of the pair of ports, the valve member having a small piston member and a large piston member interconnected thereto and being disposed spaced from each other to define an intermediate chamber therebetween. The small piston member has one side thereof exposed to the high pressure chamber and the large piston member has one side thereof exposed to a control chamber of the housing body. The valve construction is provided with means for effectively interconnecting the high pressure chamber to the intermediate chamber and the low pressure port to the control chamber to cause the valve member to slide to one position thereof in the high pressure chamber. Such means is also adapted to effectively interconnect the high pressure chamber to the control chamber and the low pressure port to the intermediate chamber to cause the valve member to slide to another position thereof in the high pressure chamber, the construction having means for effectively disconnecting the low pressure port from the intermediate chamber while maintaining the interconnection between the high pressure chamber and the control chamber when the valve member is moved to the other position thereof.

40 Claims, 5 Drawing Figures

DIFFERENTIAL PISTON TYPE REVERSING VALVE CONSTRUCTION, SYSTEM UTILIZING THE SAME AND METHOD OF MAKING

BACKGROUND OF THE INVENTION

1. Field of the Invention

This invention relates to a differential piston type reversing valve construction and to a heat exchanger system utilizing the same as well as to methods of making such a reversing valve construction and such a heat exchanger system.

2. Prior Art Statement

It is known to provide a differential piston type reversing valve construction having a housing body provided with a high pressure chamber that has a valve member slideable therein for selectively interconnecting the high pressure chamber to either port of a pair of ports interrupting a valve seat of the housing body while interconnecting a low pressure port of the valve seat to the other port of the pair of ports, the valve member having a small piston member and a large piston member interconnected thereto and being spaced from each other to define an intermediate chamber therebetween with the small piston member having one side thereof exposed to the high pressure chamber and the large piston member having one side thereof exposed to a control chamber of the housing body.

For example, see the following two items:

(1) U.S. Pat. No. 3,894,561—Thornbery.

(2) See FIGS. 1 and 2 of this application which disclose a device known to applicants.

It appears that the differential piston type reversing valve constructions of items (1) and (2) above each has the intermediate chamber thereof that is disposed between the small and large pistons thereof continuously interconnected to the low pressure of the system utilizing the same regardless of the position of the main slide valve member of the reversing valve construction.

SUMMARY OF THE INVENTION

It is a feature of this invention to provide a differential piston type reversing valve construction wherein fluid leakage to the intermediate chamber defined between the small piston member and large piston member thereof is held to a minimum or substantially eliminated.

In particular, it is believed that in a differential piston type reversing valve construction wherein the intermediate chamber between the small piston member and large piston member thereof is continuously interconnected to the low pressure side of the heat exchanger system utilizing the same, there would be a tendency for the high pressure fluid exposed to one side of the small piston member to continuously leak past the small piston member to the low pressure intermediate chamber. Likewise, it is believed that there would be a tendency for the high pressure directed to a control chamber exposed to one side of the large piston member to tend to continuously leak past the large piston member to the low pressure intermediate chamber.

It is believed that this inherent leakage problem of the prior known differential piston type reversing valve constructions lowers the efficiency thereof.

However, it was found according to the teachings of this invention that such inherent leakage problem might be overcome or substantially eliminated if the intermediate chamber between the small piston member and the large piston member of a differential piston type reversing valve construction was not continuously interconnected to the low pressure side of the system utilizing the same and still have the small piston member and large piston member be utilized to shift the valve member of the reversing valve construction between the operating positions thereof.

In particular, one embodiment of this invention provides a differential piston type reversing valve construction having a housing body provided with a pressure chamber that has a valve member slideable therein for selectively interconnecting the high pressure chamber to either port of a pair of ports interrupting a valve seat of the housing body while interconnecting a low pressure port of the valve seat to the other port of the pair of ports, the valve member having a small piston member and a large piston member interconnected thereto and being spaced from each other to define an intermediate chamber therebetween. The small piston member has one side thereof exposed to the high pressure chamber and the large piston member has one side thereof exposed to a control chamber of the housing body. The valve construction has means for effectively interconnecting in the high pressure chamber to the intermediate chamber and the low pressure port to the control chamber to cause the valve member to slide to one position thereof in the high pressure chamber. Such means is also adapted to effectively interconnect the high pressure chamber to the control chamber and the low pressure port to the intermediate chamber to cause the valve member to slide to another position thereof in the high pressure chamber.

The large piston member is provided with means for completely closing off the interconnection of the low pressure to the intermediate chamber when the valve member has been moved to one of its positions so that the intermediate chamber will not continuously leak its fluid pressure to the low pressure side of the system utilizing the same once the large piston member of this invention closes off the interconnection thereto.

Accordingly, it is an object of this invention to provide an improved differential piston type reversing valve construction having one or more of the novel features of this invention as set forth above or hereinafter shown or described.

Another object of this invention is to provide a method of making such a differential piston type reversing valve construction, the method of this invention having one or more of the novel features of this invention as set forth above or hereinafter shown or described.

Another object of this invention is to provide a heat exchanger system utilizing such a differential piston type reversing valve construction, the heat exchanger system of this invention having one or more of the novel features of this invention as set forth above or hereinafter shown or described.

Another object of this invention is to provide a method of making such a heat exchanger system, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figures 1, 2:
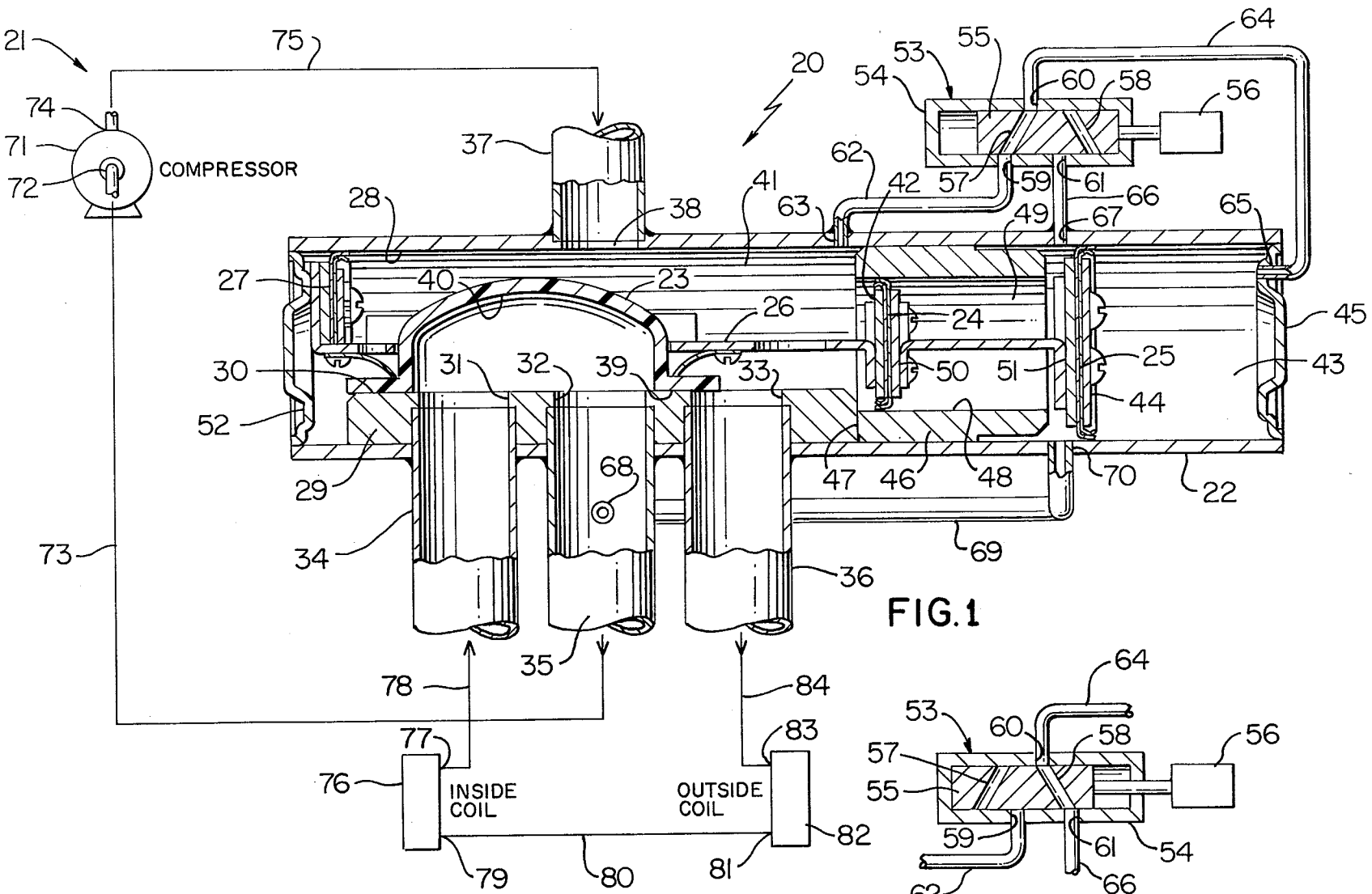
FIG. 1 is a cross-sectional view of a prior known differential piston type reversing valve construction being utilized in a heat exchanger system that is shown schematically in FIG. 1.
FIG. 2 is a fragmentary cross-sectional view of the pilot valve means of the reversing valve construction of FIG. 1 disposed in another operating position thereof.

While the various features of this invention are hereinafter described and illustrated as being particularly adapted to provide a reversing valve construction for a heat exchanger system such as a heat pump system, it is to be understood that the various features of this invention can be utilized singly or in any combination thereof to provide a reversing valve construction for other systems as desired.

Therefore, this invention is not to be limited to only the embodiment illustrated in the drawings, because the drawings are merely utilized to illustrate one of the wide variety of uses of this invention.

In order to fully understand the improved features of this invention, it is believed best to fully describe a prior known differential piston type reversing valve construction and the operation thereof so that the elimination of the inherent leakage problem thereof by the reversing valve construction of this invention will be best understood.

Accordingly, reference is now made to FIGS. 1 and 2 wherein a prior known differential piston type reversing valve construction is generally indicated by the reference numeral 20 and is illustrated for controlling a heat exchanger system of the heat pump type that is generally indicated by the reference numeral 21, the reversing valve construction 20 being generally of a type disclosed in the aforementioned U.S. Pat. No. 3,894,561 to Thornbery.

However, there are certain structural and piping differences between the valve construction 20 and system 21 of FIGS. 1 and 2 and the structure and system set forth in the aforementioned U.S. Pat. No. 3,894,561 to Thornbery.

The reversing valve construction 20 includes a metallic tubular housing member 22 having a movable valve member 23 slidingly disposed therein and being interconnected to a small diameter piston member 24 and a large diameter piston member 25 by an interconnecting member 26 that has an upstanding guide member 27 on one end thereof to slide against the internal peripheral surface 28 of the tubular housing body 22 in a manner well known in the art.

A metallic valve seat member 29 is secured in the housing body 22 to define a flat valve seat surface 30 that is interrupted by three ports 31, 32 and 33 disposed in aligned relation and respectively being fluidly interconnected to metallic tubular connectors 34, 35 and 36 while a similar metallic tubular connector 17 is disposed in fluid communication with a port 38 formed in the tubular housing body 22 opposite the valve seat 29 as illustrated.

The movable valve member 23 has a lower flat surface 39 disposed in sliding and sealing engagement with the flat surface 30 of the valve seat 29 and is interrupted by the cavity 40 to define a passage means thereof which is adapted to fluidly and sealingly interconnect the ports 31 and 32 of the valve seat 29 together when the valve member 23 is disposed in the position illustrated in FIG. 1 while the port 33 is permitted to be disposed in fluid communication with a high pressure chamber 41 of the housing body 22 and, thus, to the tubular connector 37 as illustrated, the high pressure chamber 41 being disposed to the left of the small piston member 24 and thereby being exposed to the side 42 of the small piston member 24 for a purpose hereinafter described.

However, when the valve member 23 is moved to the right in FIG. 1, the passage means or cavity 40 of the valve member 23 fluidly and sealingly interconnects the ports 32 and 33 together while permitting the port 31 to be disposed in fluid communication with the high pressure chamber 41 of the housing body 22 and, thus, in fluid communication with the tubular connector 37 for a purpose hereinafter described.

The movement of the valve member 23 relative to the housing body 22 is accomplished by directing either a high pressure or low pressure to a control chamber 43 formed in the tubular housing body 22 between the side 44 of the large piston member 25 and an end closure 45 of the tubular body 22 whereby the side 44 of the large piston member 25 is exposed to the control chamber 43.

A short tubular member 46 is disposed and secured in the housing body 22 with one end 47 thereof disposed against the valve seat 29 to position the member 46 within the housing body 22, the small piston member 24 being slideable in the tubular member 46 and adapted to seal against the internal peripheral surface 48 thereof whereby the space between the small piston member 24 and the large piston member 25 comprises an intermediate chamber 49 that comprises the portion of the tubular member 46 to the right of the small piston member 24 and the part of the housing body 22 to the left of the large piston member 25. In this manner, the intermediate chamber 49 is disposed between the facing sides 50 and 51 of the small piston member 24 and the large piston member 25 as illustrated whereby the sides 50 and 51 of small piston member 24 and the large piston member 25 are exposed to the intermediate chamber 49.

The left hand end of the high pressure chamber 41 as illustrated in FIG. 1 is closed by an end closure 52 secured to the housing body 22 in substantially the same manner as the end closure 45 at the other end of the tubular housing body 22.

The reversing valve construction 20 includes a pilot valve means that is generally indicated by the reference numeral 53 in FIGS. 1 and 2 and comprises a housing means 54 having a slide valve member 55 disposed therein and adapted to be moved from the position illustrated in FIG. 1 to the position illustrated in FIG. 2 by an actuator 56, such as a solenoid coil or the like, to provide for a reversing action of the reversing valve construction in a manner hereinafter described.

The valve member 55 has a pair of spaced passage means 57 and 58 passing therethrough with the passage means 57 being adapted to interconnect a port 59 of the housing 54 to a port 60 of the housing 54 when the valve member 55 is disposed in the position illustrated in FIG. 1.

When the valve member 55 is disposed in the position illustrated in FIG. 2, the passage 57 no longer interconnects the port 59 with the port 60 but the passage 58 now interconnects the port 60 to a port 61 of the housing 54 as illustrated in FIG. 2.

The port 59 in the housing 54 of the pilot valve means 53 is interconnected by a conduit 62 to a port 63 formed in the housing body 22 to the left of the end 47 of the tubular member 46, the port 63 always being disposed in fluid communication with the high pressure chamber 41 of the reversing valve construction 20.

The port 60 of the housing means 54 of the pilot valve means 53 is interconnected by a conduit means 64 to a port 65 formed through the end closure 45 whereby the port 65 is disposed in fluid communication with the control chamber 43 of the reversing valve construction 20.

The port 61 of the housing means 54 of the pilot valve means 53 is interconnected by a conduit means 66 to a port 67 formed through the housing body 22 and only being disposed in fluid communication with the intermediate chamber 49 regardless of the position of the valve member 23 and, thus, the position of the large piston member 25 as will be apparent hereinafter.

The intermediate or low pressure tubular member 35 of the valve construction 20 has a port 68 thereof interconnected by a conduit 69 to a port 70 of the housing body 22 that is also always disposed in fluid communication with the intermediate chamber 49 regardless of the position of the large piston member 25 for a purpose hereinafter described.

The heat exchanger or heat pump system 21 illustrated in FIG. 1 includes a refrigerator compressor 71 having the inlet or suction side thereof 72 interconnected by a conduit means 73 to the intermediate tubular connector 35 of the reversing valve construction 20 while its outlet or high pressure side 74 is interconnected by a conduit means 75 to the tubular connector 37 of the reversing valve construction 20.

An inside coil 76 of the heat exchanger system 21 has one side 77 thereof interconnected by a conduit means 78 to the tubular connector 34 of the reversing valve construction 20 while the other side 79 of the inside coil 76 is interconnected by an expansion capillary passage 80 to one side 81 of an outside coil 82. The other side 83 of the outside coil 82 is interconnected by a conduit means 84 to the tubular connector 36 of the reversing valve construction 20.

The valve member 23 of the reversing valve construction 20 of the system 21 is disposed in the position illustrated in FIG. 1 by means of the pilot valve means 53 directing high pressure fluid from the high pressure chamber 41 through the conduit means 62, passage 57, and conduit means 64 to the control chamber 43 so that the high pressure acting against the side 44 of the large piston 23 is in opposition to the low pressure in the intermediate chamber 49 acting against the side 51 of the large piston member 25 whereby such pressure differential across the large piston member 25 in opposition to the pressure differential across the small piston member 24 causes the valve member 53 to be moved and held in the position illustrated in FIG. 1 wherein the guide 27 is disposed against the end closure 52. In this position of the valve member 23, the heat pump system 21 is acting in its cooling cycle as the hot gas output from the output side 74 of the compressor 71 is being directed through the chamber 41 of the reversing valve construction 20 to the tubular connector 36 and, thus, to the side 83 of the outside coil 82 which then returns the fluid through the expansion capillary passage 80 to the inside coil 76 and through interconnected ports 34 and 32 of the valve seat 29 to the inlet side 72 of the compressor 71 by the intermediate conduit 35 whereby the inside coil 76 provides its cooling function in a manner well known in the art.

Should it be desired to reverse the heat exchanger system 21 to a heating cycle thereof, the pilot valve means 53 is actuated to the condition illustrated in FIG. 2 so as to direct the low pressure in the intermediate chamber 49 to the conduit 66, passage 58 of the valve member 55 and conduit 64 to the control chamber 43 so that now a low pressure is acting on both sides of the large piston member 25 whereby the pressure differential acting across the small piston member 24 moves the small piston 24 and, thus, the valve member 23 to the right in FIG. 1 until the large piston member 25 abuts against the end closure 45 at which time the cavity or passage means 40 of the valve member 23 is bridging the ports 32 and 33 together while exposing the port 31 to the high pressure chamber 41. In this manner, the flow of hot gases from the inlet 74 of the compressor 71 is now directed to the port 31 of the valve seat 29 and, thus, to the side 77 of the inside coil 76 which now performs its heating function. The return of heat exchanger fluid from the inside coil 76 is directed by the expansion capillary passage 80 to the outside coil 82 and, thus, from the outside coil 82 through the interconnected passages or ports 33 and 32 of the valve seat 29 back to the inlet side 72 of the compressor 71 in a manner well known in the art.

Thus, it can be seen that the reversing valve construction of 20 can be utilized to reverse the cycle of operation of the heat exchanger system 21 in the above manner.

However, it is well known that the efficiency of a reversing valve construction depends upon leakage and pressure drop across the valving arrangement of the valve seat and valve member thereof. Thus, the greater the leakage of high pressure fluid from the chamber 41 back to the inlet side 72 of the compressor 71 without passing through the coil means 76, 82, the lower the efficiency of the system 21.

As previously stated, it is believed according to this invention that since the intermediate chamber 49 of the reversing valve construction 20, as well as the reversing valve construction of the aforementioned U.S. patent to Thornbery, U.S. Pat. No. 3,894,561, is always at a low pressure by being interconnected by the conduit 67 to the return tubular conduit 35, high pressure fluid in the high pressure chamber 41 will tend to leak across the small piston member 24 to the intermediate chamber 48 and thereby by-pass the coil means 76, 82. Similarly, when the reversing valve construction 20 is disposed in the position illustrated in FIG. 1, wherein high pressure fluid from the high pressure chamber 41 is being continuously directed by the pilot valve means 53 to the control chamber 43, the high pressure in the control chamber 43 might tend to leak across the large piston member 25 to the low pressure intermediate chamber 49 and, thus, be by-passed to the inlet side 72 of the compressor 71 without passing through the coil means 76, 82.

Thus, it is believed according to the teachings of this invention that there is an inherent fluid leakage problem by having the intermediate chamber 49 of the differential piston type reversing valve construction 20 continuously interconnected to the inlet or suction side 72 of the compressor 71.

However, as previously stated, it is a feature of this invention to tend to substantially eliminate or substantially reduce such leakage problem.

Figure 3:
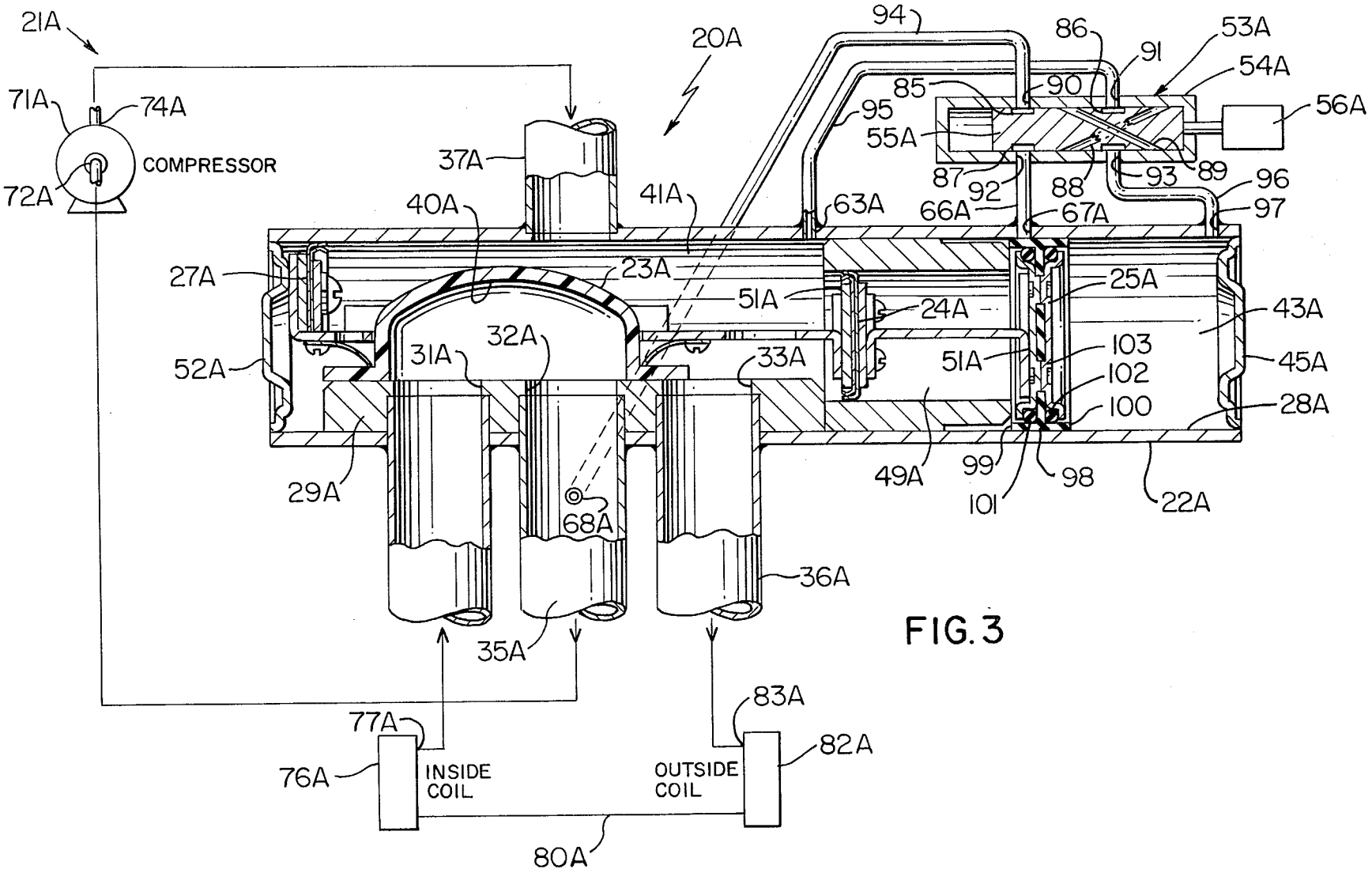
FIG. 3 is a view similar to FIG. 1 and illustrates the improved differential piston type reversing valve construction of this invention and the heat exchanger system of this invention utilizing the same.
Figures 4, 5:
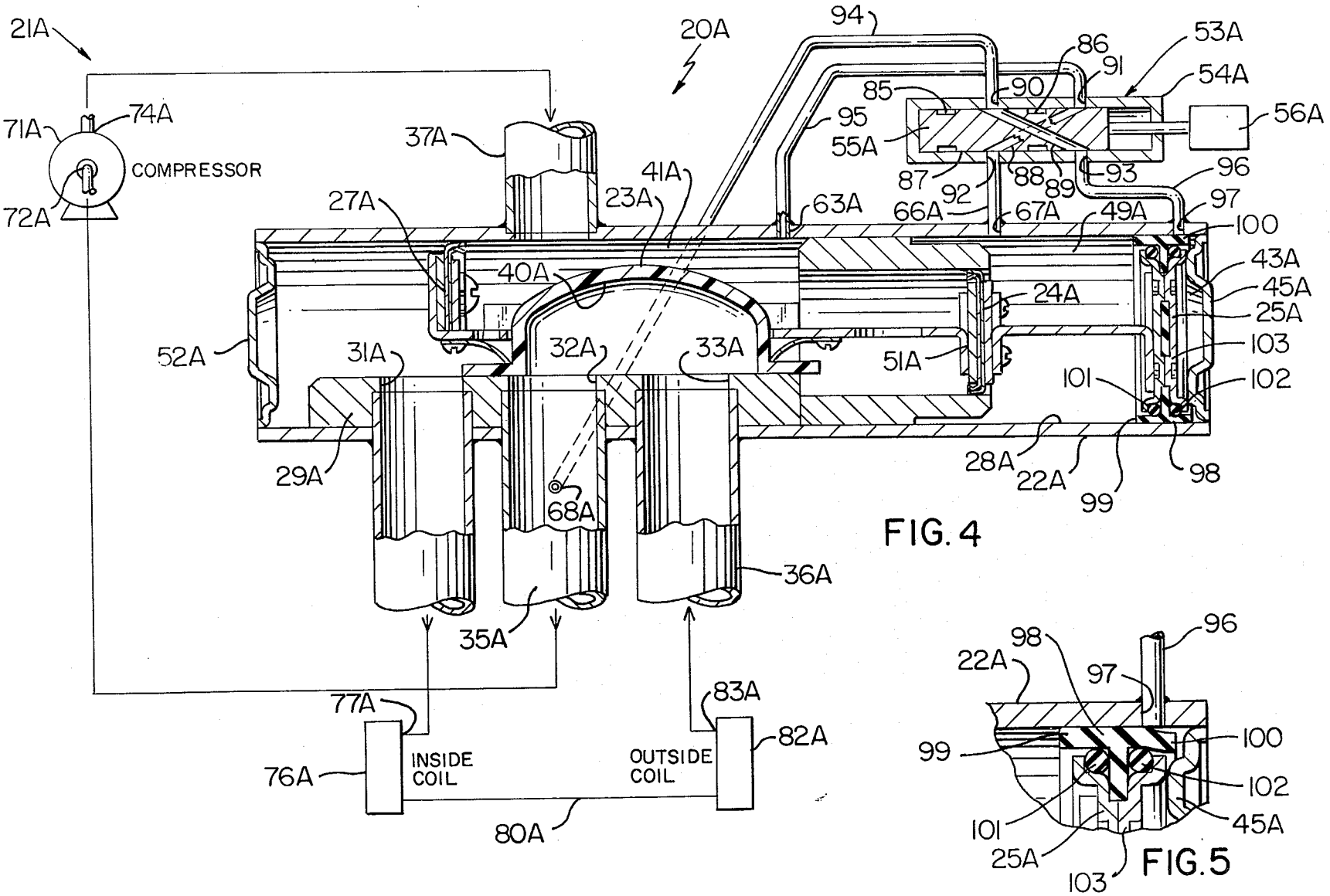
FIG. 4 is a view similar to FIG. 3 and illustrates the reversing valve construction disposed in another operating condition thereof.
FIG. 5 is an enlarged, fragmentary, cross-sectional view of a part of the reversing valve construction of FIG. 4.

Accordingly, reference is now made to FIGS. 3 and 4 wherein the improved reversing valve construction of this invention is generally indicated by the reference numeral 20A and is being utilized in a heat exchanger system generally indicated by the reference numeral 21A whereby parts of the valve construction 20A and system 21A of this invention that are similar to like parts of the reversing valve construction 20 and system 21 previously described are indicated by like reference numerals followed by the reference letter "A".

As illustrated in FIGS. 3 and 4, it can be seen that the heat exchanger system 21A is identical to the heat exchanger system 21 previously described and that the reversing valve construction 20A is substantially identical to the reversing valve construction 20 previously described except that the pilot valve means 53A and conduit means thereof have been changed as well as the structure of the large piston member 25A.

In particular, the valve member 55A of the pilot valve means 53A has a pair of annular recesses 85 and 86 provided in the outer peripheral surface 87 thereof and a pair of cross passages 88 and 89 that are separate from each other.

The housing member 54A of the pilot valve means 53A has four ports 90, 91, 92 and 93 formed therein in such a manner that when the valve member 55A of the pilot valve 53A is disposed in the position illustrated in FIG. 3, the ports 90 and 92 are interconnected by the annular recess 85 of the valve member 55A while the ports 91 and 93 are interconnected by the annular recess 86, the cross passages 88 and 89 being non-functional in this position of the valve member 55A.

However, when the valve member 55A of the pilot valve means 53A is moved to the position illustrated in FIG. 4 by the actuator 56A, it can be seen that the annular recesses 85 and 86 are now rendered non-functional while the cross passage 89 interconnects the ports 90 and 91 together and the cross passage 88 interconnects the ports 91 and 92 together for a purpose hereinafter described.

The port 90 of the pilot valve means 53A is interconnected by a conduit means 94 to the port 68A of the low pressure tubular connector 35A.

The port 91 of the pilot valve means 53A is interconnected by a conduit means 95 to the port 63A of the housing body 22A.

The port 93 of the pilot valve means 53A is interconnected by a conduit means 96 to a port 97 formed in the housing body 22A in a manner to be adapted to be in fluid communication with the control chamber 43A under certain conditions of the reversing valve construction 20A as will be apparent hereinafter.

The large piston member 25A has an outer resilient annular portion 98 having the opposed ends 99 and 100 thereof respectively urged outwardly by annular O-ring like resilient members 101 and 102 carried by a body portion 103 of the piston member 25A and being under compression in the manner fully set forth and claimed in the co-pending patent application Ser. No. 958,029, filed Nov. 6, 1978.

In this manner, when the large piston member 25A is disposed in the position illustrated in FIG. 3, the end 99 of the annular resilient member 98 is urged into sealing engagement with the internal peripheral surface 28A of the tubular housing body 22A by the compressed resilient member 101 to sealingly close the port 67A, particularly when the pressure differential across the part 99 of the resilient member 98 is in direction to close the port 67A as will be apparent hereinafter. Similarly, when the large piston member 25A is disposed in the position illustrated in FIG. 4, the end 100 of the annular resilient member 98 is urged into sealing engagement against the internal peripheral surface 28A of the housing member 22A by the compressed O-ring resilient member 102 to sealingly close the port 97, particularly when the pressure differential across the part 100 of the resilient member 98 is in the direction to close the port 97 as will be apparent hereinafter.

Thus, it can be seen that the changes made by this invention to the reversing valve construction 20 previously described are relatively minor and is believed that the reversing valve construction 20A will operate in an improved manner over the operation of the reversing valve construction 20 previously described.

In particular, the operation of the reversing valve construction 20A of this invention as utilized in the system 21A of this invention will now be described.

The valve member 23A of the reversing valve construction 20A of the system 21A is disposed in the position illustrated in FIG. 3 by means of the pilot valve means 53A directing high pressure to the control chamber 43A by means of the port 63A, conduit 95, port 91 annular recess 86 in the valve member 55A, port 93, conduit 96 and port 97 whereby the high pressure in the control chamber 43A has moved and holds the valve member 23A in the position illustrated in FIG. 3 as the guide member 27A is disposed against the end closure 52A. In this manner, the heat exchanger system 21A is acting in its cooling cycle as the hot gas output from the output side 74A of the compressor 71A is being directed through the high pressure chamber 41A of the reversing valve construction 21A into the tubular connector 36A and, thus, to the side 83A of the outside coil 82A which then returns through the expansion capillary passage 80A to the inside coil 76A and through the interconnected ports 31A and 32A of the valve seat 29A to the inlet side 72A of the compressor 71A whereby the inside coil 76A provides its cooling function.

With the large piston member 25A in the position illustrated in FIG. 3, it can be seen that the annular resilient member 98 thereof has its end 99 held in sealing engagement by a compressed O-ring resilient member 101 against the internal peripheral surface 28A of the tubular housing body 22A to seal closed the port 67A so that no high fluid pressure can enter the port 67A from the intermediate chamber 49A and be directed by the conduit 66A, annular recess 85 of the valve member 55A and conduit 94 to the low pressure tubular connector 55A.

Further, the sealing of the end 99 of the resilient member 98 of the large piston member 25A against the port 67A is assisted by any pressure differential acting across the end 99 in a direction to close the port 67A. In particular, any leakage of high pressure fluid from the high pressure chamber 41A across the small piston member 24A into the chamber 49A and/or from the high pressure control chamber 43A across the large piston member 25A into the intermediate chamber 49A is completely confined in the chamber 49A as any resulting pressure differential across the end 99 of the resilient member 98 of the large piston member 25A is in a direction to seal the end 99 in a closing direction against the port 67A, so that once the fluid pressure in the chamber 49A builds up to the same pressure value as in the pressure value in the high pressure chamber 41A, no further fluid leakage will take place into the intermediate chamber 49A. Thus, since leakage from the intermediate chamber 49A to the port 67A is completely blocked by the sealing annular resilient member 98 of the large piston member 25A, there is no continuous leakage path to the low pressure side of the compressor 71A around the coil means 76A, 82A as provided by the intermediate chamber 49 of the reversing valve construction 20 previously described since the intermediate chamber 49 thereof is continuously interconnected to the low pressure tubular connector 35 by the conduit 67 and, thus, to the suction side 72 of the compressor 71.

Should it be desired to reverse the heat exchanger system 21A to a heating cycle thereof, the pilot valve means 53A is actuated to the position illustrated in FIG. 4 wherein the valve member 55A thereof now has the cross passage 89 thereof interconnecting the low pressure in the tubular connector 35A to the control chamber 43A by means of the port 68A, conduit means 94, port 90, cross passage 89, port 93, conduit means 96 and port 97 so that the resulting pressure differential acting across the small piston member 24A, if the pressure value in intermediate chamber 49A is lower than the pressure value in the high pressure chamber 41A and, if not, the effective resulting pressure differential acting across the large piston member 25A by having the intermediate chamber 49A at a pressure value larger than the pressure value of the low pressure now in the control chamber 43A will cause the valve member 23A to move from the position illustrated in FIG. 3 to the position illustrated in FIG. 4 where the large piston member 25A abuts against the end closure 45A.

As the large piston member 25A is moving from the position illustrated in FIG. 3 towards the position illustrated in FIG. 4 in the above manner, it can be seen that the annular resilient member 98 thereof uncovers the port 67A whereby the pilot valve means 53A can now interconnect the high pressure to the intermediate chamber 49A to directly assist the movement of the large piston member 25A to the right from the position illustrated in FIG. 3 to the position illustrated in FIG. 4.

In particular, the high pressure chamber 41A is interconnected to the intermediate chamber 49A by means of the port 63A, conduit 95, port 91, cross passage 88, port 92, conduit 66A and now uncovered port 67A so that when the reversing valve construction 20A is disposed in the position illustrated in FIG. 4, the intermediate chamber 49A is at a high pressure value equal to the high pressure value in the high pressure chamber 41A.

However, the pressure in the intermediate chamber 49A cannot escape back to the inlet 72A of the compressor 71A because when the large piston member 25A is disposed in its stopped position against the end closure 45A in the manner illustrated in FIG. 4, it can be seen that the annular resilient peripheral member 98 thereof has its end 100 held in sealing compression by the O-ring 102 against the internal peripheral surface 28A of the tubular housing body 21A in a manner to seal closed the port 97 to block any connection back to the low pressure tubular connector 35A. Further, any leakage of pressure fluid into the control chamber 43A creates a pressure differential across the end 100 of the resilient member 98 of the large piston 25A in a direction to more fully close against the port 97. Thus, once the pressure value in the control chamber 43A comes up to the same pressure value as in the intermediate chamber 49A, no further leakage across the large piston member 25A can take place.

With the reversing valve construction 20A now in the condition illustrated in FIG. 4, it can be seen that the ports 32A and 33A are now interconnected together by the cavity 40A of the valve member 23A. In this manner, the flow of hot gases from the outlet 74A of the compressor 71A is now directed to the port 31A of the valve seat 29A and, thus, to the side 77A of the inside coil 76A which now performs its heating function. The return from the inside coil 76A is directed by the expansion capillary passage 80A to the outside coil 82A and, thus, from the outside coil 82A through the interconnected passages 33A and 32A of the valve seat 29A back to the inlet side 72A of the compressor 71A in a manner well known in the art.

Thus, it can be seen that the reversing valve construction 20A can be utilized to reverse the cycle of operation of the heat exchanger system 21A in the above manner.

With the reversing valve construction 20A now in the condition illustrated in FIG. 4, and it is desired to reverse the reversing valve construction 20A back to the condition illustrated in FIG. 3, the pilot valve means 53A is actuated by the actuator 56A thereof from the position illustrated in FIG. 4 back to the position illustrated in FIG. 3 whereby it can be seen that the high pressure of the high pressure chamber 41A is now interconnected by the pilot valve means 53A to the intermediate chamber 49A in the manner previously described. This results in a pressure differential across the large piston member 25A because of the low pressure now being on the side 51A thereof and the force of the high pressure fluid in the chamber 43A caused by the aforementioned leakage in the chamber 43A from the chamber 49A or now being created in the control chamber 43A by the force of the high pressure fluid acting at the port 97 to flex open the end 100 of the resilient member 98 of the large piston member 25A as illustrated in FIG. 5 and escaping past the end 100 of the annular resilient member 98 into the control chamber 43A whereby the large piston member 25A is moved to the left back to the position illustrated in FIG. 3 to again perform the cooling cycle for the heat exchanger system 21A by the inside coil 76A thereof in the manner previously described.

Therefore, it can be seen that the intermediate chamber 49A of the differential piston type reversing valve construction 20A of this invention is never continuously interconnected to a low pressure or suction source in either of the positions of FIG. 3 and FIG. 4 thereof because when the reversing valve construction 20A is in the position of FIG. 3, the low pressure port 67A is closed off by the resilient means 98 of the large piston member 25A and is assisted in such closing off by the pressure differential acting across the end 99 of the resilient member 98 in the manner previously described.

Conversely, when the reversing valve construction 20A is disposed in the position illustrated in FIG. 4, it can be seen that the intermediate chamber 49A is interconnected to the high pressure chamber 41A so that the same is not interconnected to a low pressure or suction source as in the reversing valve construction 20 previously described and the pressure differential acting across the resilient member 98 of the main valve member 25A caused by any leakage of the high pressure in the intermediate chamber 49A to control chamber 43A and the low pressure being interconnected to the port 97 holds the end 100 of the resilient member 98 closed against the port 97 in the manner previously described.

Therefore, it can be seen that this invention not only provides an improved differential piston type reversing valve construction and method of making the same, but also this invention provides an improved heat exchanger system utilizing such a reversing valve construction and a method of making such a heat exchanger system.

While the forms and methods of this invention, now preferred, have been illustrated and described as required by the Patent Statute, it is to be understood that other forms and method steps can be utilized and still fall within the scope of the appended claims.

What is claimed is:

1. In a differential piston type reversing valve construction having a housing body provided with a high pressure chamber that has a valve member slideable therein for selectively interconnecting said high pressure chamber to either port of a pair of ports interrupting a valve seat of said housing body while interconnecting a low pressure port of said valve seat to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising means of said valve construction for effectively interconnecting said high pressure chamber to said intermediate chamber and said low pressure port to said control chamber to cause said valve member to slide to one position thereof in said high pressure chamber, said means also being adapted to effectively interconnect said high pressure chamber to said control chamber and said low pressure port to said intermediate chamber to cause said valve member to slide to another position thereof in said high pressure chamber, said construction having means for effectively disconnecting said low pressure port from said intermediate chamber while maintaining the interconnection between said high pressure chamber and said control chamber when said valve member is moved to said other position thereof.

2. A differential piston type reversing valve construction as set forth in claim 1 wherein said means of said construction for effectively disconnecting said low pressure port from said intermediate chamber comprises said large piston member.

3. A differential piston type reversing valve construction as set forth in claim 1 wherein said means includes a pilot valve means.

4. A differential piston type reversing valve construction as set forth in claim 1 wherein said housing body comprises a single tubular member having said chambers disposed in aligned relation therein.

5. In a differential piston type reversing valve construction having a housing body provided with a high pressure chamber that has a valve member slideable therein for selectively interconnecting said high pressure chamber to either port of a pair of ports interrupting a valve seat of said housing body while interconnecting a low pressure port of said valve seat to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising means of said valve construction for effectively interconnecting said high pressure chamber to said intermediate chamber and said low pressure port to said control chamber to cause said valve member to slide to one position thereof in said high pressure chamber, said means also being adapted to effectively interconnect said high pressure chamber to said control chamber and said low pressure port to said intermediate chamber to cause said valve member to slide to another position thereof in said high pressure chamber, said means including means defining an opening in said housing body that intersects with said intermediate chamber, said large piston member having means for closing said opening when said valve member is in said other position thereof.

6. A differential piston type reversing valve construction as set forth in claim 5 wherein said means of said large piston member comprises a resilient outer peripheral portion of said large piston member.

7. In a differential piston type reversing valve construction having a housing body provided with a high pressure chamber that has a valve member slideable therein for selectively interconnecting said high pressure chamber to either port of a pair of ports interrupting a valve seat of said housing body while interconnecting a low pressure port of said valve seat to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising means of said valve construction for effectively interconnecting said high pressure chamber to said intermediate chamber and said low pressure port to said control chamber to cause said valve member to slide to one position thereof in said high pressure chamber, said means also being adapted to effectively interconnect said high pressure chamber to said control chamber and said low pressure port to said intermediate chamber to cause said valve member to slide to another position thereof in said high pressure chamber, said means including means defining an opening in said housing body that intersects with said control chamber, said large piston member having means for closing said opening when said valve member is in said one position thereof.

8. A differential piston type reversing valve construction as set forth in claim 7 wherein said means of said large piston member comprises a resilient outer peripheral portion of said large piston member.

9. In a differential piston type reversing valve construction having a housing body provided with a high pressure chamber that has a valve member slideable therein for selectively interconnecting said high pressure chamber to either port of a pair of ports interrupting a valve seat of said housing body while interconnecting a low pressure port of said valve seat to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising means of said valve construction for effectively interconnecting said high pressure chamber to said intermediate chamber and said low pressure port to said control chamber to cause said valve member to slide to one position thereof in said high pressure chamber, said means also being adapted to effectively interconnect said high pressure chamber to said control chamber and said low pressure port to said intermediate chamber to cause said valve member to slide to another position thereof in said high pressure chamber, said means including means defining a first opening in said housing body that intersects with said intermediate chamber and a second opening in said housing body that intersects with said control chamber, said large piston member having means for closing said first opening when said valve member is in said other position thereof and for closing said second opening when said valve member is in said one position thereof.

10. A differential piston type reversing valve construction as set forth in claim 9 wherein said means of said large piston comprises a resilient outer peripheral portion of said large piston member.

11. In a heat exchanger system wherein a high pressure of said system is delivered by a reversing valve construction in one direction while said reversing valve construction is returning a low pressure of said system in another direction, said reversing valve construction being of a differential piston type and having a housing body provided with a high pressure chamber that is interconnected to said high pressure of said system and that has a valve member slideable therein for selectively interconnecting said high pressure chamber to either port of a pair of ports interrupting a valve seat of said housing body while interconnecting a low pressure port of said valve seat that is interconnected to said low pressure of said system to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising means of said valve construction for effectively interconnecting said high pressure of said system to said intermediate chamber and said low pressure of said system to said control chamber to cause said valve member to slide to one position thereof in said high pressure chamber, said means also being adapted to effectively interconnect said high pressure of said system to said control chamber and said low pressure of said system to said intermediate chamber to cause said valve member to slide to another position thereof in said high pressure chamber, said construction having means for effectively disconnecting said low pressure of said system from said intermediate chamber while maintaining the interconnection between said high pressure of said system and said control chamber when said valve member is moved to said other position thereof.

12. A heat exchanger system as set forth in claim 11 wherein said means of said construction for effectively disconnecting said low pressure of said system from said intermediate chamber comprises said large piston member.

13. A heat exchanger system as set forth in claim 11 wherein said means includes a pilot valve means.

14. A heat exchanger system as set forth in claim 11 wherein said housing body comprises a single tubular member having said chambers disposed in aligned relation therein.

15. In a heat exchanger system wherein a high pressure of said system is delivered by a reversing valve construction in one direction while said reversing valve construction is returning a low pressure of said system in another direction, said reversing valve construction being of a differential piston type and having a housing body provided with a high pressure chamber that is interconnected to said high pressure of said system and that has a valve member slideable therein for selectively interconnecting said high pressure chamber to either port of a pair of ports interrupting a valve seat of said housing body while interconnecting a low pressure port of said valve seat that is interconnected to said low pressure of said system to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising means of said valve construction for effectively interconnecting said high pressure of said system to said intermediate chamber and said low pressure of said system to said control chamber to cause said valve member to slide to one position thereof in said high pressure chamber, said means also being adapted to effectively interconnect said high pressure of said system to said control chamber and said low pressure of said system to said intermediate chamber to cause said valve member to slide to another position thereof in said high pressure chamber, said means including means defining an opening in said housing body that intersects with said intermediate chamber, said large piston member having means for closing said opening when said valve member is in said other position thereof.

16. A heat exchanger system as set forth in claim 15 wherein said means of said large piston member comprises a resilient outer peripheral portion of said large piston member.

17. In a heat exchanger system wherein a high pressure of said system is delivered by a reversing valve construction in one direction while said reversing valve construction is returning a low pressure of said system in another direction, said reversing valve construction being of a differential piston type and having a housing body provided with a high pressure chamber that is interconnected to said high pressure of said system and that has a valve member slideable therein for selectively interconnecting said high pressure chamber to either port of a pair of ports interrupting a valve seat of said housing body while interconnecting a low pressure port of said valve seat that is interconnected to said low pressure of said system to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising means of said valve construction for effectively interconnecting said high pressure of said system to said intermediate chamber and said low pressure of said system to said control chamber to cause said valve member to slide to one piston thereof in said high pressure chamber, said means also being adapted to effectively interconnect said high pressure of said system to said control chamber and said low pressure of said system to said intermediate chamber to cause said valve member to slide to another position thereof in said high pressure chamber, said means including means defining an opening in said housing body that intersects with said control chamber, said large piston member having means for closing said opening when said valve member is in said one position thereof.

18. A heat exchanger system as set forth in claim 17 wherein said means of said large piston member comprises a resilient outer peripheral portion of said large piston member.

19. In a heat exchanger system wherein a high pressure of said system is delivered by a reversing valve construction in one direction while said reversing valve construction is returning a low pressure of said system in another direction, said reversing valve construction being of a differential piston type and having a housing body provided with a high pressure chamber that is interconnected to said high pressure of said system and that has a valve member slideable therein for selectively interconnecting said high pressure chamber to either port of a pair of ports interrupting a valve seat of said housing body while interconnecting a low pressure port of said valve seat that is interconnected to said low pressure of said system to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising means of said valve construction for effectively interconnecting said high pressure of said system to said intermediate chamber and said low pressure of said system to said control chamber to cause said valve member to slide to one position thereof in said high pressure chamber, said means also being adapted to effectively interconnect said high pressure of said system to said control chamber and said low pressure of said system to said intermediate chamber to cause said valve member to slide to another position thereof in said high pressure chamber, said means including means defining a first opening in said housing body that intersects with said intermediate chamber and a second opening in said housing body that intersects with said control chamber, said large piston member having means for closing said first opening when said valve member is in said other position thereof and for closing said second opening when said valve member is in said one position thereof.

20. A heat exchanger system as set forth in claim 19 wherein said means of said large piston comprises a resilient outer peripheral portion of said large piston member.

21. In a method of making a differential piston type reversing valve construction having a housing body provided with a high pressure chamber that has a valve member slideable therein for selectively interconnecting said high pressure chamber to either port of a pair of ports interrupting a valve seat of said housing body while interconnecting a low pressure port of said valve seat to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising the steps of forming said valve construction with means for effectively interconnecting said high pressure chamber to said intermediate chamber and said low pressure port to said control chamber to cause said valve member to slide to one position thereof in said high pressure chamber, forming said means to also be adapted to effectively interconnect said high pressure chamber to said control chamber and said low pressure port to said intermediate chamber to cause said valve member to slide to another position thereof in said high pressure chamber, and forming said construction with means for effectively disconnecting said low pressure port from said intermediate chamber while maintaining the interconnection between said high pressure chamber and said control chamber when said valve member is moved to said other position thereof.

22. A method of making a differential piston type reversing valve construction as set forth in claim 21 and including the step of forming said means of said construction for effectively disconnecting said low pressure port from said intermediate chamber to comprise said large piston member.

23. A method of making a differential piston type reversing valve construction as set forth in claim 21 and including the step of forming said means to include a pilot valve means.

24. A method of making a differential piston type reversing valve construction as set forth in claim 21 and including the step of forming said housing body to comprise a single tubular member having said chambers disposed in aligned relation therein.

25. In a method of making a differential piston type reversing valve construction having a housing body provided with a high pressure chamber that has a valve member slideable therein for selectively interconnecting said high pressure chamber to either port of a pair of ports interrupting a valve seat of said housing body while interconnecting a low pressure port of said valve seat to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising the steps of forming said valve construction with means for effectively interconnecting said high pressure chamber to said intermediate chamber and said low pressure port to said control chamber to cause said valve member to slide to one position thereof in said high pressure chamber, forming said means to also be adapted to effectively interconnect said high pressure chamber to said control chamber and said low pressure port to said intermediate chamber to cause said valve member to slide to another position thereof in said high pressure chamber, forming said means to include an opening in said housing body that intersects with said intermediate chamber, and forming said large piston member with means for closing said opening when said valve member is in said other position thereof.

26. A method of making a differential piston type reversing valve construction as set forth in claim 25 and including the step of forming said means of said large piston member to comprise a resilient outer peripheral portion of said large piston member.

27. In a method of making a differential piston type reversing valve construction having a housing body provided with a high pressure chamber that has a valve member slideable therein for selectively interconnecting said high pressure chamber to either port of a pair of ports interrupting a valve seat of said housing body while interconnecting a low pressure port of said valve seat to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising the steps of forming said valve construction with means for effectively interconnecting said high pressure chamber to said intermediate chamber and said low pressure port to said control chamber to cause said valve member to slide to one position thereof in said high pressure chamber, forming said means to also be adapted to effectively interconnect said high pressure chamber to said control chamber and said low pressure port to said intermediate chamber to cause said valve member to slide to another position thereof in said high pressure chamber, forming said means to include an opening in said housing body that intersects with said control chamber, and forming said large piston member with means for closing said opening when said valve member is in said one position thereof.

28. A method of making a differential piston type reversing valve construction as set forth in claim 27 and including the step of forming said means of said large piston member to comprise a resilient outer peripheral portion of said large piston member.

29. In a method of making a differential piston type reversing valve construction having a housing body provided with a high pressure chamber that has a valve member slideable therein for selectively interconnecting said high pressure chamber to either port of a pair of ports interrupting a valve seat of said housing body while interconnecting a low pressure port of said valve seat to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising the steps of forming said valve construction with means for effectively interconnecting said high pressure chamber to said intermediate chamber and said low pressure port to said control chamber to cause said valve member to slide to one position thereof in said high pressure chamber, forming said means to also be adapted to effectively interconnect said high pressure chamber to said control chamber and said low pressure port to said intermediate chamber to cause said valve member to slide to another position thereof in said high pressure chamber, forming said means to include a first opening in said housing body that intersects with said intermediate chamber and a second opening in said housing body that intersects with said control chamber, and forming said large piston member with means for closing said first opening when said valve member is in said other position thereof and for closing said second opening when said valve member is in said one position thereof.

30. A method of making a differential piston type reversing valve construction as set forth in claim 29 and including the step of forming said means of said large piston to comprise a resilient outer peripheral portion of said large piston member.

31. In a method of making a heat exchanger system wherein a high pressure of said system is delivered by a reversing valve construction in one direction while said reversing valve construction is returning a low pressure of said system in another direction, said reversing valve construction being of a differential piston type and having a housing body provided with a high pressure chamber that is interconnected to said high pressure of said system and that has a valve member slideable therein for selectively interconnecting said high pressure chamber to either port of a pair of ports interrupting a valve seat of said housing body while interconnecting a low pressure port of said valve seat that is interconnected to said low pressure of said system to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising the steps of forming said valve construction with means for effectively interconnecting said high pressure of said system to said intermediate chamber and said low pressure of said system to said control chamber to cause said valve member to slide to one position thereof in said high pressure chamber, forming said means to also be adapted to effectively interconnect said high pressure of said system to said control chamber and said low pressure of said system to said intermediate chamber to cause said valve member to slide to another position thereof in said high pressure chamber, and forming said construction with means for effectively disconnecting said low pressure of said system from said intermediate chamber while maintaining the interconnection between said high pressure of said system and said control chamber when said valve member is moved to said other position thereof.

32. A method of making a heat exchanger system as set forth in claim 31 and including the step of forming said means of said construction for effectively disconnecting said low pressure port from said intermediate chamber to comprise said large piston member.

33. A method of making a heat exchanger system as set forth in claim 31 and including the step of forming said means to include a pilot valve means.

34. A method of making a heat exchanger system as set forth in claim 31 and including the step of forming said housing body to comprise a single tubular member having said chambers disposed in aligned relation therein.

35. In a method of making a heat exchanger system wherein a high pressure of said system is delivered by a reversing valve construction in one direction while said reversing valve construction is returning a low pressure of said system in another direction, said reversing valve construction being of a differential piston type and having a housing body provided with a high pressure chamber that is interconnected to said high pressure of said system and that has a valve member slideable therein for selectively interconnecting said high pressure chamber to either port of a pair of ports interrupting a valve seat of said housing body while interconnecting a low pressure port of said valve seat that is interconnected to said low pressure of said system to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising the steps of forming said valve construction with means for effectively interconnecting said high pressure of said system to said intermediate chamber and said low pressure of said system to said control chamber to cause said valve member to slide to one position thereof in said high pressure chamber, forming said means to also be adapted to effectively interconnect said high pressure of said system to said control chamber and said low pressure of said system to said intermediate chamber to cause said valve member to slide to another position thereof in said high pressure chamber, forming said means to include an opening in said housing body that intersects with said intermediate chamber, and forming said large piston member with means for closing said opening when said valve member is in said other position thereof.

36. A method of making a heat exchanger system as set forth in claim 35 and including the step of forming said means of said large piston member to comprise a resilient outer peripheral portion of said large piston member.

37. In a method of making a heat exchanger system wherein a high pressure of said system is delivered by a reversing valve construction in one direction while said reversing valve construction is returning a low pressure of said system in another direction, said reversing valve construction being of a differential piston type and having a housing body provided with a high pressure chamber that is interconnected to said high pressure of said system and that has a valve member slideable therein for selectively interconnecting said high pressure chamber to either port of a pair of ports interrupting a valve seat of said housing body while interconnecting a low pressure port of said valve seat that is interconnected to said low pressure of said system to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising the steps of forming said valve construction with means for effectively interconnecting said high pressure of said system to said intermediate chamber and said low pressure of said system to said control chamber to cause said valve member to slide to one position thereof in said high pressure chamber, forming said means to also be adapted to effectively interconnect said high pressure of said system to said control chamber and said low pressure of said system to said intermediate chamber to cause said valve member to slide to another position thereof in said high pressure chamber, forming said means to include an opening in said housing body that intersects with said control chamber, and forming said large piston member with means for closing said opening when said valve member is in said one position thereof.

38. A method of making a heat exchanger system as set forth in claim 37 and including the step of forming said means of said large piston member to comprise a resilient outer peripheral portion of said large piston member.

39. In a method of making a heat exchanger system wherein a high pressure of said system is delivered by a reversing valve construction in one direction while said reversing valve construction is returning a low pressure of said system in another direction, said reversing valve construction being of a differential piston type and having a housing body provided with a high pressure chamber that is interconnected to said high pressure of said system and that has a valve member slideable therein for selectively interconnecting said high pressure chamber to either port of a pair of ports interrupting a valve seat of said housing body while interconnecting a low pressure port of said valve seat that is interconnected to said low pressure of said system to the other port of said pair of ports, said valve member having a small piston member and a large piston member interconnected thereto and being spaced from each other to define an intermediate chamber therebetween, said small piston member having one side thereof exposed to said high pressure chamber and said large piston member having one side thereof exposed to a control chamber of said housing body, the improvement comprising the steps of forming said valve construction with means for effectively interconnecting said high pressure of said system to said intermediate chamber and said low pressure of said system to said control chamber to cause said valve member to slide to one position thereof in said high pressure chamber, forming said means to also be adapted to effectively interconnect said high pressure of said system to said control chamber and said low pressure of said system to said intermediate chamber to cause said valve member to slide to another position thereof in said high pressure chamber, forming said means to include a first opening in said housing body that intersects with said intermediate chamber and a second opening in said housing body that intersects with said control chamber, and forming said large piston member with means for closing said first opening when said valve member is in said other position thereof and for closing said second opening when said valve member is in said one position thereof.

40. A method of making a heat exchanger system as set forth in claim 39 and including the step of forming said means of said large piston to comprise a resilient outer peripheral portion of said large piston member.

* * * * *